US006810891B2

(12) United States Patent
Ma

(10) Patent No.: US 6,810,891 B2
(45) Date of Patent: Nov. 2, 2004

(54) UMBRELLA CANOPY ORIENTATING DEVICE

(76) Inventor: Joen-Shen Ma, 12F, No. 578, Kwang Fu South Road, Taipei (TW)

( * ) Notice: Subject to any disclaimer, the term of this patent is extended or adjusted under 35 U.S.C. 154(b) by 0 days.

(21) Appl. No.: 10/304,677

(22) Filed: Nov. 27, 2002

(65) Prior Publication Data

US 2004/0099297 A1 May 27, 2004

(51) Int. Cl.[7] ..... A45B 11/00
(52) U.S. Cl. ..... 135/20.3
(58) Field of Search ..... 135/20.1, 20.3, 135/25.4, 19, 15.1; 403/112, 113, 52, 117, 119, 161

(56) References Cited

U.S. PATENT DOCUMENTS 2,595,697 A * 5/1952 Pereira ..... 135/20.3
2,863,466 A * 12/1958 Small ..... 135/20.3
3,926,202 A * 12/1975 Uthemann et al. ..... 135/20.3

* cited by examiner

*Primary Examiner*—Leslie A. Braun
*Assistant Examiner*—Kofi Schulterbrandt

(57) ABSTRACT

An umbrella includes a center rod having upper and lower sections. A canopy is attached to an upper end of the upper section. A lower end of the lower section is mounted to a base positionable on a fixed surface for supporting the central rod in an upright manner. A canopy orientating device is arranged between a lower end of the upper section and an upper end of the lower section. The canopy orientating device includes a skirt-like diverging opening formed in the lower end of the upper section and defined by opposite inclined side walls. The upper end of the lower section is received in the diverging opening. A pivot pin extends through both the upper and lower sections to rotatably mount the upper section to the lower section whereby the upper section and thus the canopy are allowed to rotate about the pivot pin with respect to the lower section between a neutral position where the upper section is substantially aligned with the lower section and an inclined position where the upper end of the lower section engages one of the inclined side walls to orient the canopy in an inclined direction with respect to the lower section.

2 Claims, 5 Drawing Sheets

UMBRELLA CANOPY ORIENTATING DEVICE

BACKGROUND OF THE INVENTION

1. Field of the Invention

The present invention generally relates to a large-sized umbrella, and in particular to an umbrella having a canopy that is capable to be oriented in inclined directions.

2. The Related Art

Large-sized umbrellas are widely used in a variety of applications, such as beach umbrellas and garden umbrellas, for shading intense sunlight. Thus, some of the large-sized umbrellas are provided with a mechanism for orienting the canopy in order to adapt to the direction of sunlight. Such a mechanism is often mounted on a central rod of the umbrella. The most commonly seen mechanism for orienting the canopy is a pivotal joint formed between upper and lower sections of the central rod that allows for rotation of the upper section on which the canopy is mounted with respect to the lower section that is secured on ground. A latch is arranged between the upper and lower sections to engage holes defined in the central rod in order to selectively fix the upper section at a desired position with respect to the lower section. Such an orientating mechanism has a complicated structure and thus difficult to operate. In addition, the complicated structure raises the manufacturing costs of the umbrella.

Another conventional orientating mechanism for large-sized umbrellas includes a rope that drives the upper section with respect to the lower section and selectively fixes the upper section at different positions with respect to the lower section. A reel and associated winding mechanism are required for operating the rope. Again, the structure of the conventional orientating mechanism is complicated and costly. Maintenance and manufacturing are difficult too.

Thus, it desired to have a canopy orientating device for a large-sized umbrella that overcomes the above problems.

SUMMARY OF THE INVENTION

An object of the present invention is to provide a canopy orientating device for large-sized umbrellas having a simple structure and thus easy to operate.

Another object of the present invention is to provide a canopy orientating device for large-sized umbrellas having low manufacturing and maintenance costs.

To achieve the above objects, in accordance with the present invention, there is provided a canopy orientating device for an umbrella comprising a center rod comprised of upper and lower sections. A canopy is attached to an upper end of the upper section. A lower end of the lower section is mounted to a base positionable on a fixed surface for supporting the central rod in an upright manner. The canopy orientating device is arranged between a lower end of the upper section and an upper end of the lower section, comprising a skirt-like diverging opening formed in the lower end of the upper section and defined by opposite inclined side walls. The upper end of the lower section is received in the diverging opening. A pivot pin extends through both the upper and lower sections to rotatably mount the upper section to the lower section whereby the upper section and thus the canopy are allowed to rotate about the pivot pin with respect to the lower section between a neutral position where the upper section is substantially aligned with the lower section and an inclined position where the upper end of the lower section engages one of the inclined side walls to orient the canopy in an inclined direction with respect to the lower section.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
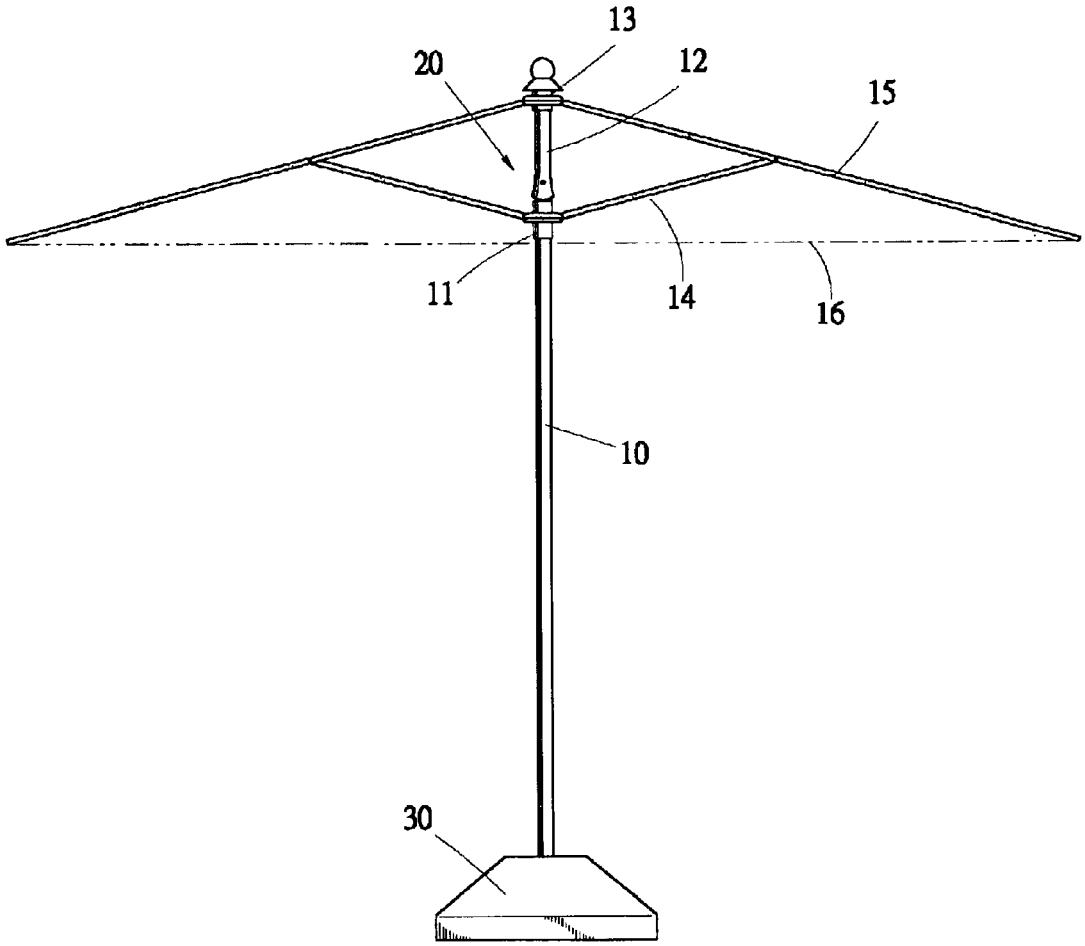
FIG. 1 is a side elevational view of a large-sized umbrella in which a canopy orientating device constructed in accordance with the present invention is embodied.
Figure 2:
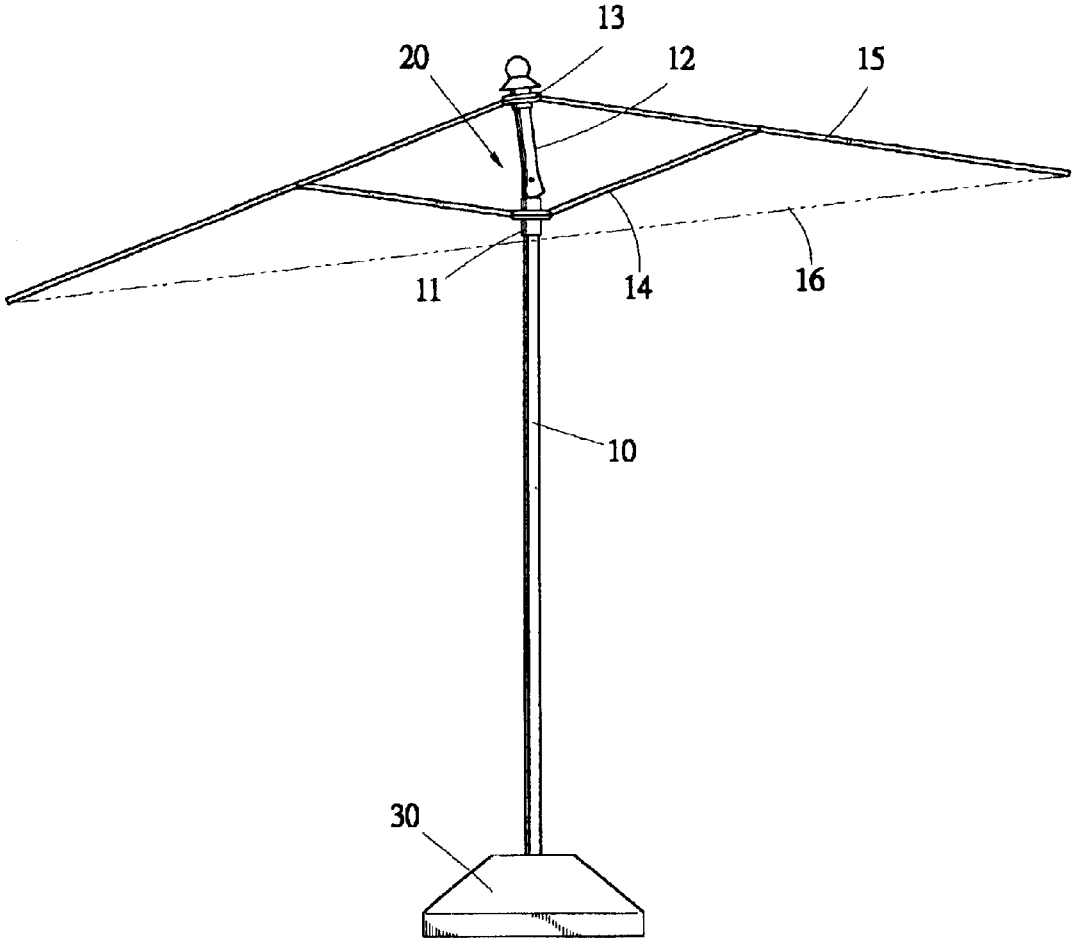
FIG. 2 is similar to FIG. 1 but showing a canopy of the umbrella is oriented in an inclined direction.

With reference to the drawings and in particular to FIGS. 1 and 2, an umbrella in which a canopy orientating device constructed in accordance with the present invention is embodied is shown. The umbrella comprises a central rod arranged on an upright manner. The central rod comprises a lower section 10 and an upper section 12. The lower section 10 has a lower end mounted to a base 30 positioned on a fixed surface. The upper section 12 has an upper end to which a crown 13 is attached. A runner 11 is movably fit over and slidable along the lower section 10 of the central rod. A plurality of ribs 15 is pivotally attached to the crown 13 and radially extends from the crown 13 for supporting a canopy 16. A stretcher 14 has opposite ends respectively pivoted to the runner 11 and each rib 15. Moving the runner 11 toward the crown 13 drives the stretchers 14 to expand the ribs 15, thus opening the umbrella canopy 16, and moving the runner 11 away from the crown 13 allows the ribs 15 to collapse and thus closing the umbrella canopy 16.

Figure 3:
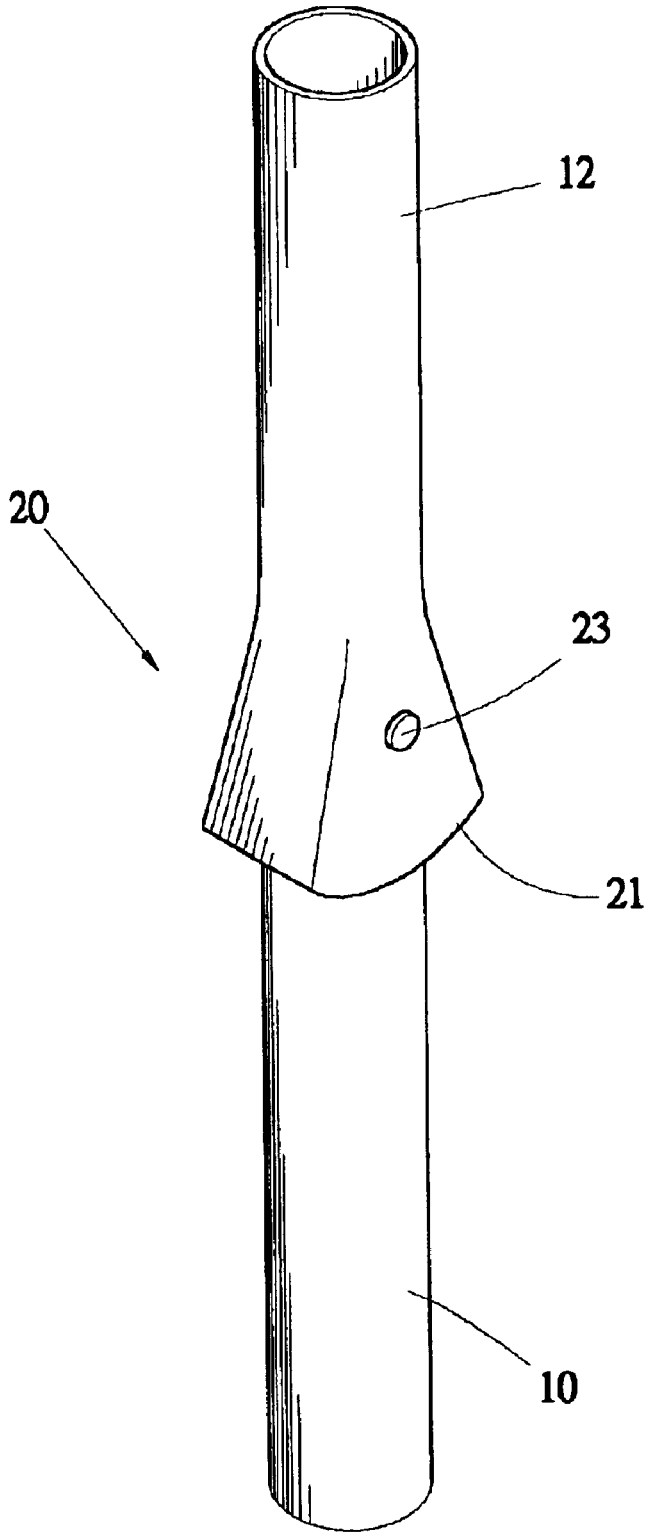
FIG. 3 is a perspective view of the canopy orientating device of the present invention.
Figure 4:
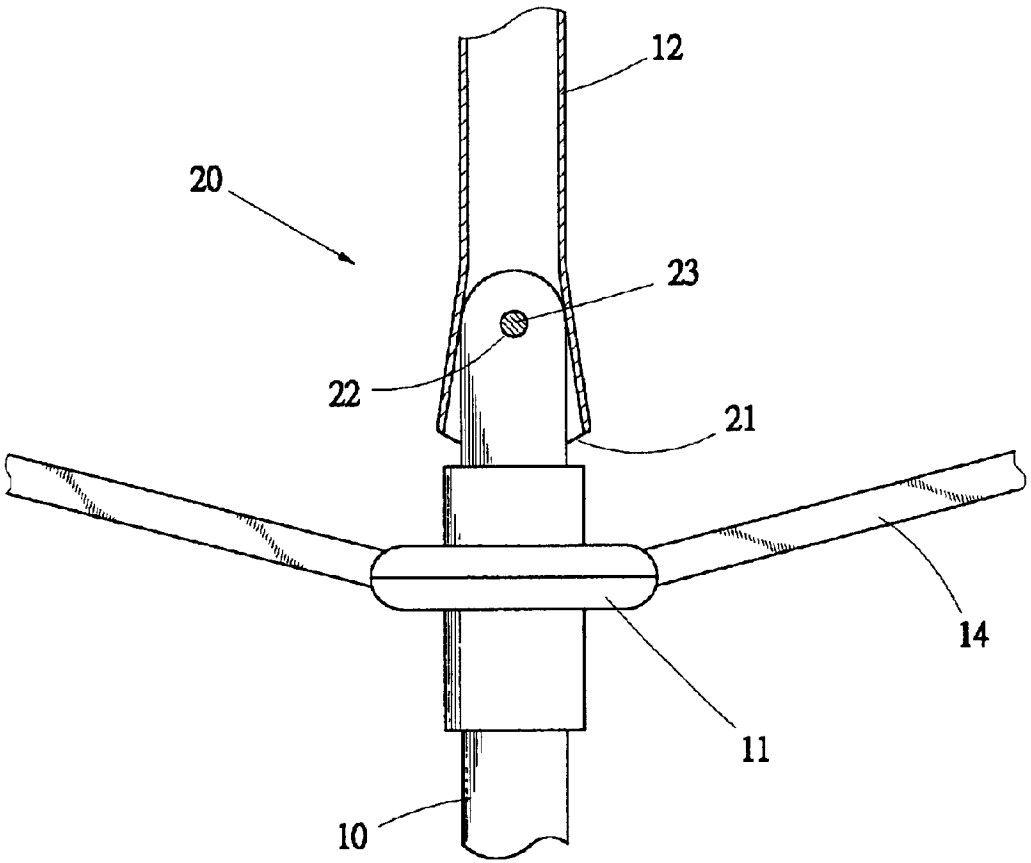
FIG. 4 is a cross-sectional view of the canopy orientating device in a neutral position.
Figure 5:
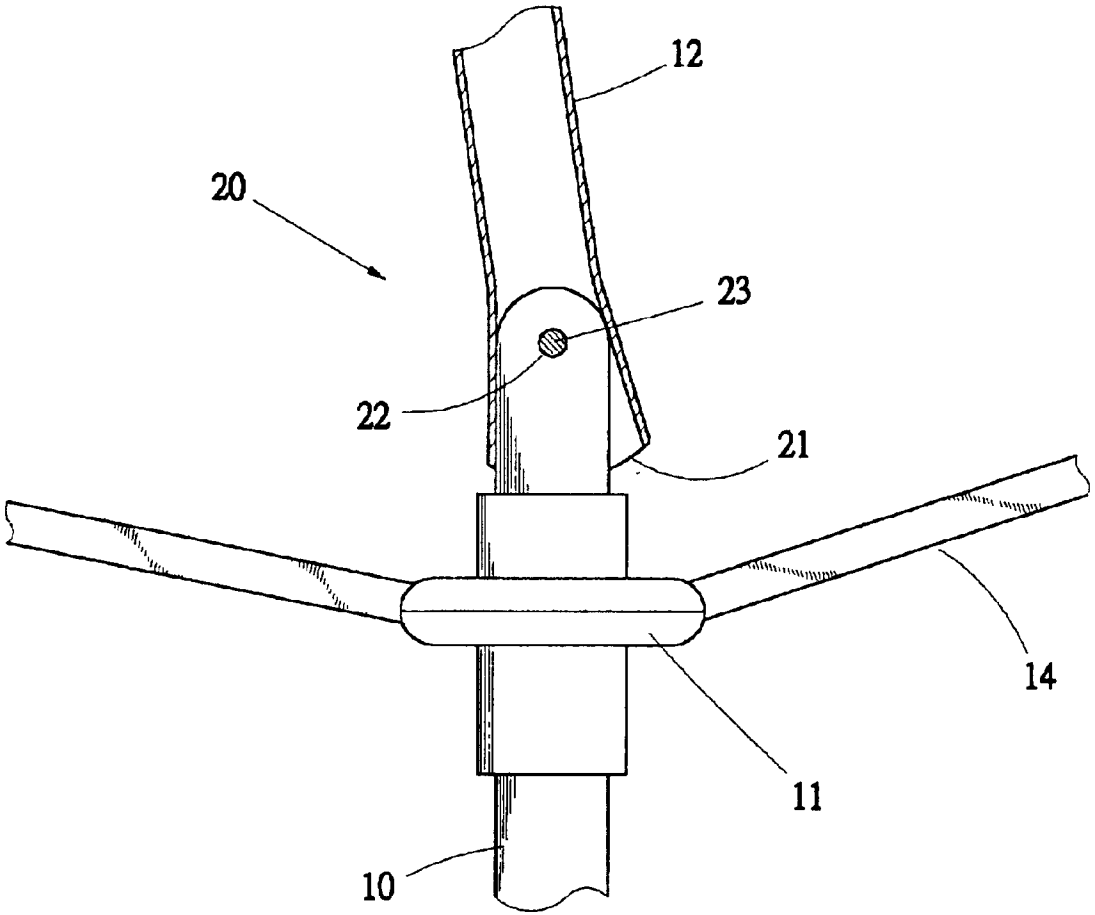
FIG. 5 is similar to FIG. 4 but showing the canopy orientating device in an inclined position.

Also referring to FIGS. 3–5, the umbrella comprises an canopy orientating device 20 that is arranged between upper end of the lower section 10 and the lower end of the upper section 12 for moving the upper section 12 with respect to the lower section 10 between a neutral position, as shown in FIGS. 1 and 4, and an inclined position, as shown in FIGS. 2 and 5, thereby orienting the canopy 16 in inclined directions.

The orientating device 20 comprises a diverging opening 21 defined in the lower end of the upper section 12 thereby forming a skirt configuration having opposite inclined side walls (not labeled). The upper end of the lower section 10 forms a rounded configuration received in the diverging opening 21 of the upper section 12. A through hole 22 is defined in the rounded end of the lower section 10 and receives a pivot pin 23 which also extends through the upper section 12 in such a direction that allows the upper section 12 to rotate about the pivot pin 23 with respect to the lower section 10 with the lower section 10 engageable with the inclined side walls of the upper section 12 to stop the rotation, as shown in FIG. 5.

When the umbrella is initially opened, without being acted upon by an external force, the canopy 16 that is often made of flexible materials gives a tension that maintains the upper section 12 in a neutral position with respect to the lower section 10 wherein the upper section 12 is substantially aligned with the lower section 10, as shown in FIGS. 1 and 4. To change the direction of the canopy 16, manually rotating the upper section 12 with respect to the lower section 10 about the pivot pin 23, the upper section 12 and thus the canopy 16 are moved with respect to the lower section 10 which brings one of the inclined side walls of the upper section 12 toward and eventually engaging the upper end of the lower section 10 thereby fixing the upper section 12 and the canopy 16 at the inclined position with respect to the lower section 10, as shown in FIGS. 2 and 5.

By rotating the lower section 10 about a central axis thereof with respect to the base 30 or by simply rotating the base 30, the canopy 16 that is inclined with respect to the lower section 10 can be brought to any desired direction to adapt to the direction of sun light.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. An umbrella having a canopy orientation structure, comprising:

a central rod having an upper section pivotally coupled to a lower section positionable on a fixed surface;

a crown secured to an upper portion of said upper section of said central rod;

a plurality of ribs pivotally coupled to said crown;

an umbrella canopy formed of a flexible material and supported on said plurality of ribs;

a runner slideably disposed on said lower section of said central rod;

a plurality of stretchers, each of said stretchers being pivotally coupled on one end to said runner and on an opposing end to a corresponding one of said plurality of ribs; and, a canopy orientating device disposed above said runner, said canopy orienting device including:

a) a diverging opening formed in a lower end of said upper section, said diverging opening having a pair of opposite inclined side walls;

b) an upper end of the lower section being received in said diverging opening; and c) a pivot pin pivotally mounting said upper section to said lower section, wherein said umbrella canopy through said ribs and stretchers provides a bias force to said canopy orientating device to releasably hold said upper section in axially aligned relationship with said lower section, said upper section and said umbrella canopy therewith being angularly displaceable to a position where said upper end of the lower section is in contact with a respective of said inclined side walls of the diverging opening of said upper section.

2. The umbrella as recited in claim 1, wherein said upper section of said central rod is formed of a tubular member and said inclined side walls are formed by corresponding portions of an outer wall of said tubular member.

* * * * *